US005565666A

United States Patent [19]

Kautz

[11] Patent Number: 5,565,666

[45] Date of Patent: Oct. 15, 1996

[54] TRIP FREE MANUAL RESET SWITCH USING AN M-BLADE

[75] Inventor: Thomas O. Kautz, Mequon, Wis.

[73] Assignee: Johnson Service Company, Milwaukee, Wis.

[21] Appl. No.: 414,766

[22] Filed: Mar. 31, 1995

[51] Int. Cl.[6] ..... H01H 35/34; H01H 13/36

[52] U.S. Cl. ..... 200/83 P; 29/622; 200/467; 337/391

[58] Field of Search ..... 337/343, 347, 337/349, 365, 379, 390, 391; 29/622, 446, 450, 756; 307/118; 340/611, 626, 665; 73/723, 729.1; 200/405–408, 441, 467, 81.4, 81.5, 83 C, 83 P, 83 R, 246, 283, 330–332

[56] References Cited

U.S. PATENT DOCUMENTS

| | | | |
|---|---|---|---|
| Re. 28,578 | 10/1975 | Burch et al. | 200/67 |
| 3,946,352 | 3/1976 | Nelson | 337/361 |
| 4,032,734 | 6/1977 | Burch | 200/67 |
| 4,297,552 | 10/1981 | Lauritsen | 200/83 P |
| 4,325,046 | 4/1982 | Burch | 337/56 |
| 4,424,506 | 1/1984 | Burch | 337/365 |
| 4,796,355 | 1/1989 | Burch et al. | 29/622 |
| 5,001,317 | 3/1991 | Atkinson | 200/83 P |

FOREIGN PATENT DOCUMENTS

| | | | |
|---|---|---|---|
| 1250553 | 12/1960 | France | 200/83 P |

OTHER PUBLICATIONS

Kautz, Tom, "M–Blade Study Progress Report," Jun. 14, 1993. pp. 1–60.

"Tie–Down–Safe Thermostat. (M2)" pp. 5,6 no date.

*Primary Examiner*—Gerald P. Tolin

*Attorney, Agent, or Firm*—Harness, Dickey & Pierce, P.L.C.

[57] ABSTRACT

A switch for interrupting an electrical circuit in response to a mechanical interaction, such as an overpressure or underpressure condition. The switch includes an actuation arm electrically connected to a common terminal. The actuation arm is moveable between a first position and a second position in response to the mechanical condition. The switch further includes an M-blade operatively connected to the actuation arm. The M-blade levers from a first configuration to a second configuration when the actuation arm moves from the first position to the second position. The M-blade completes the electrical circuit in the first configuration and interrupts the electrical circuit in the second configuration. The switch further includes a reset actuator disposed to engage the M-blade in response to a reset actuation. The M-blade levers from the second configuration to the first configuration when the reset actuator engages the M-blade and the actuation arm is not in the second position.

16 Claims, 6 Drawing Sheets

TRIP FREE MANUAL RESET SWITCH USING AN M-BLADE

FIELD OF THE INVENTION

The present invention generally relates to a switch for electrically coupling a common contact with a normally closed contact or a normally open contact. More particularly, the present invention relates to a pressure detection switch for interrupting an electrical circuit and completing another electrical circuit in response to a detected pressure condition. The detected pressure condition may exceed a pressure limit in a first embodiment or be less than a pressure limit in a second embodiment.

BACKGROUND OF THE INVENTION

A variety of switches and other actuators have been developed for switching an electrical circuit in response to a mechanical overload condition. One such mechanical overload condition is an overpressure condition, where fluid pressure exceeds a predetermined threshold. Another such mechanical overload condition in an underpressure condition, where fluid pressure is less than a predetermined threshold. In response to the overpressure or underpressure condition, the switch interrupts one electrical circuit, completes a second electrical circuit, or both. This switching causes the associated circuit or circuits to act to correct the detected condition.

One prior art switch which trips in response to an overpressure condition uses a flat metal leaf, fixed at one end, the other end having one or more electrical contacts. Mechanical force is applied along the leaf. This force distorts the leaf so that it has two mechanically stable operating positions, one when the leaf is convex, the other when the leaf is concave. The detected pressure is applied to the leaf when the leaf is in the convex position. When the pressure exceeds a threshold, the leaf snaps from the convex position to the concave position and the switch trips, interrupting one circuit, completing another circuit, or both. The threshold is set by the physical design of the switch including the thickness and elasticity of the leaf and the applied distorting mechanical force. The switch further includes a reset button. When the reset button is pressed, an insulating portion of the reset switch engages the leaf and returns the leaf from the concave to the convex position.

One limitation of this prior art switch is the reduction in force applied by the leaf to the switch contact before the switch trips. The pressure applied to the leaf urges the contacts which complete the circuit apart in response to the overpressure condition. As the pressure increases, the force the leaf applies to close the contacts decreases until the pressure is sufficient to move the leaf from the convex position to the concave position.

This reduction in force creates an operational limitation for this prior art switch. Many such switches operate in environments where the switch is subject to conditions such as mechanical jarring or vibration. The reduced force applied by the leaf to the contacts immediately prior to tripping may permit jarring or vibration to trip the switch prematurely, causing inaccurate operation. In addition, the reduced force in the presence of jarring or vibration may cause contact chatter, i.e. the repeated high frequency opening and closing of the contacts without actual switch tripping. Chatter, in turn, may cause contact arcing which damages the contact surfaces. Due to contact arcing, the contact surfaces or contacts may need to be inspected and replaced more frequently, increasing the cost and likelihood of inaccurate operation.

Other switches have been developed which use an M-blade as a snap-acting mechanical switching element. The M-blade is fabricated with a split either between its outer legs or at its center. A bi-stable condition of the M-blade is created either by pulling its outer legs together or by spreading its center legs apart. A portion of the metal M-blade is fixed to a support with force applied to distort the legs of the M-blade. In this arrangement, the legs of the M-blade snap in an over-center fashion between a first mechanically stable position and a second mechanically stable position.

An important characteristic of the M-blade is that the force applied by the legs of the blade increases when approaching snap and remains high until slightly before the point where snap occurs. While the M-blade contact force decreases slightly prior to snap, the contact force is still considerably higher than switches in which the contact force steadily declines to zero just prior to snap. Thus, switches have been made utilizing M-blade mechanisms to provide improved performance in conditions where severe vibration or jarring may occur.

In addition to tripping in response to a detected condition, a switch must be resettable following correction of the overload condition to allow subsequent detection and tripping. Manual reset switches require actual intervention by the user or operator to depress the reset button or otherwise provide a reset actuation. However, the overload condition may occur or continue while the reset actuation is taking place. A trip free reset switch prevents the protective purpose of the switch from being defeated by holding down or jamming the reset button to continue providing the reset actuation.

The aforementioned prior art switch using a concave-convex leaf as a pressure-sensitive switching element lacks a convenient trip free reset capability. Resetting is more directly accomplished by depressing a reset button which engages the center portion of the leaf and moves the leaf from the concave position to the convex position, resetting the switch. However, holding down or jamming the reset button holds the leaf in the convex position, preventing tripping of the switch and allowing a potentially dangerous overload or overpressure condition to continue. No convenient, trip free, resettable switch has been implemented using an M-blade.

Accordingly, there is a need for a trip free, resettable switch which is immune to premature tripping as a result of vibration or jarring.

SUMMARY OF THE INVENTION

The present invention provides a pressure detection switch for interrupting an electrical circuit in response to a pressure condition. The detected pressure condition may be either an overpressure condition in which the detected pressure exceeds a predetermined limit or an underpressure condition in which the detected pressure is less than a predetermined limit. The pressure detection switch comprises an actuation arm electrically connected to a common terminal, the actuation arm being movable between a first position and a second position in response to the detected pressure condition. The pressure detection switch further comprises an M-blade operatively connected to the actuation arm, the M-blade levering from a first configuration to a second configuration when the actuation arm moves from the first position to the second position. The M-blade completes the electrical circuit in the first configuration and interrupts the electrical circuit in the second configuration. The pressure detection switch further comprises a reset actuator disposed to engage the M-blade in response to a reset actuation, the M-blade levering from the second configuration to the first configuration when the reset actuator engages the M-blade and the actuation arm is not in the second position.

The present invention further provides a switch for selectively electrically coupling a common contact with a normally closed contact or a normally open contact. The switch comprises an actuation arm in electrical contact with the common contact and having a first end and a second end, the second end moving in a first direction in response to an input actuation. The switch further comprises an M-blade in electrical contact with the actuation arm, the M-blade having a center portion fixed to the second end of the actuation arm and a first contact and a second contact. The M-blade levers to move the first contact from electrical contact with the normally closed contact and to move the second contact into electrical contact with the normally open contact when the second end of the actuation arm moves in the first direction. The switch further comprises a reset actuator having one or more tabs which move in a second direction opposite the first direction to engage the M-blade in response to a reset actuation. The one or more tabs work through the M-blade to move the second end of the actuation arm in the second direction, levering the M-blade about the normally open contact to move the second contact from electrical contact with the normally open contact and to move the first contact into electrical contact with the normally closed contact.

BRIEF DESCRIPTION OF THE DRAWING

The features of the present invention which are believed to be novel are set forth with particularity in the appended claims. The invention, together with further objects and advantages thereof, may best be understood by making reference to the following description taken in conjunction with the accompanying drawings in which like reference numerals identify identical elements and wherein:

DETAILED DESCRIPTION OF THE PREFERRED EMBODIMENT

Figure 1:
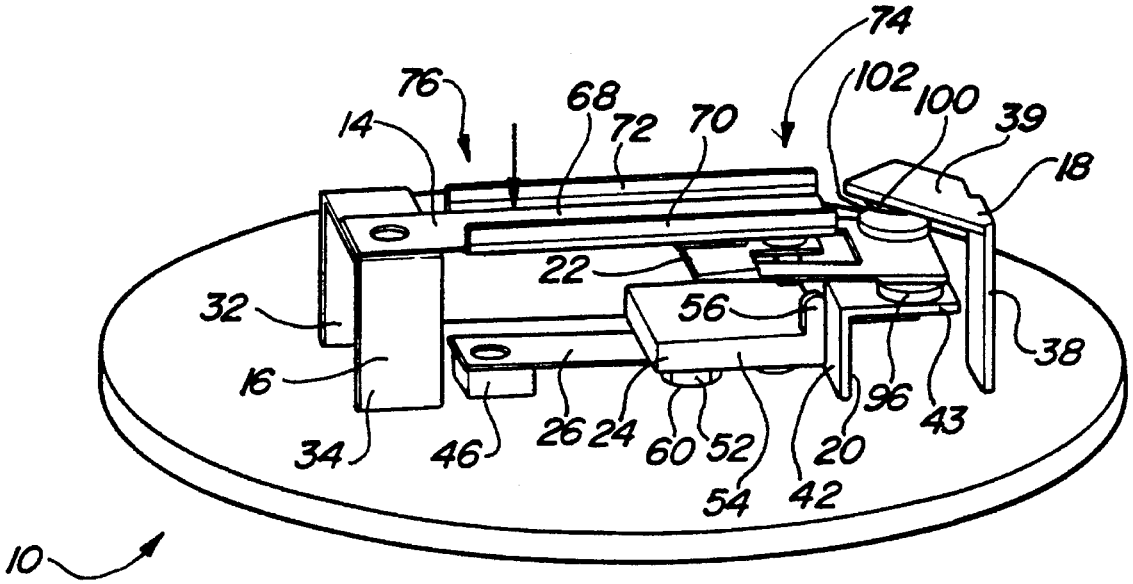
FIG. 1 is a first perspective view of a first embodiment of a switch.

Referring now to FIGS. 1–6, a first embodiment of a switch 10 according to the present invention includes a base 12, an actuation arm 14, a common contact post 16, a normally open (NO) contact post 18, a normally closed (NC) contact post 20, an M-blade 22, a reset button 24 a leaf spring 26, a common terminal 31, a normally open terminal 33 and a normally closed terminal 37. The switch 10 detects a mechanical condition, such as a fluid pressure, applied as an input actuation to the actuation arm 14. When the condition exceeds a predetermined threshold which defines the trip point of the switch 10, the switch 10 trips, interrupting an electrical connection between the normally closed terminal 37 and the common terminal 31 and completing an electrical connection between the normally open terminal 33 and the common terminal 31. A reset actuation may be subsequently applied to the reset button 24 to reset the switch 10 by interrupting the electrical connection between the normally open terminal 33 and the common terminal 31 and completing the electrical connection between the normally closed terminal 37 and the common terminal 31.

The base 12 includes a first aperture 28. The common contact post 16 includes a first leg 30, a second leg 32 and a third leg 34 for supporting the common contact post 16 on the base 12. An extended portion 35 of the first leg 30 extends through the first aperture 28 to provide the common terminal 31 for the switch 10. The common contact post 16 is preferably fabricated of metal or other electrically conducting material.

The base 12 further includes a second aperture 36. The normally open contact post 18 includes a horizontal portion 39 and a leg 38 which extends through the second aperture 36 to provide the normally open terminal 33 for the switch 10. The normally open contact post 18 is preferably fabricated of metal or other electrically conducting material.

The base 12 still further includes a third aperture 40. The normally closed contact post 20 includes horizontal portion 43 and a leg 42 which extends through the third aperture 40 to provide the normally closed terminal 37 for the switch 10. The normally closed contact post 20 is preferably fabricated of metal or other electrically conducting material.

The leaf spring 26 includes an aperture 44 at a first end 25 of the leaf spring 26 by which the leaf spring 26 may be fastened to a support 46 disposed on the surface of the base 12. The leaf spring 26 may be fastened to the support 46 by a rivet, a screw or any other appropriate means. The leaf spring 26 ie preferably fabricated out of metal or other flexible material.

At the second end 27 of the leaf spring 26, the leaf spring 26 includes an aperture 48 and an aperture 50. The reset button 24 includes a fastener 51 (FIG. 6), a reset post 52, a body 54 and a first tab 56 and a second tab 58. The reset button post 52 is press fit into aperture 48 of leaf spring 26. With the fastener 51 extending through the aperture 50, the reset button 24 cannot rotate on leaf spring 26. The reset post 52 extends through the aperture 48 in the leaf spring 26 and through an aperture 60 in the base 12. In this manner, force applied to the reset poet 52 along an axis 62 (FIG. 6) displaces the reset button 24 from the position where it is maintained by the leaf spring 26. When the force applied along with axis 62 is removed, the leaf spring 26 returns the reset button 24 to its original position. In place of the leaf spring 26, any other suitable biasing element, such as a coil spring, may be used to return the reset button to its original position.

The common contact post 16 includes an aperture 64. The actuation arm 14 includes an aperture 66. The actuation arm 14 may be fastened to the common contact post 16 using a fastener such as a rivet or screw (not shown) inserted through aperture 64 and aperture 66. The actuation arm 14 is maintained in electrical contact with the common contact post 16 and the common terminal 31.

The actuation arm 14 is preferably metal or other electrically conducting flexible material. The actuation arm 14 has a first end 74 and a second end 76. The actuation arm 14 includes a flat body 68 and two upraised side portions 70 and 72. The upraised side portions 70, 72 preferably do not extend along the entire length of the body 68. By varying the length of the side portions 70, 72, as well as other physical characteristics of the actuation arm 14, the flexibility or elasticity of the actuation arm 14 may be varied. By varying the flexibility or elasticity of the actuation arm 14, the force needed to move the actuation arm relative to the base 12, and thus the trip point of the switch 10, may be varied. The first end 74 of the actuation arm 14 includes an aperture 78. The actuation arm is in electrical contact with the common contact post 16 including the common terminal 31.

The M-blade 22 is preferably fabricated of metal or other electrical conductor and includes a center portion 80, a first leg 82, a second leg 84 and inner legs 81, 83. In FIGS. 1–6 the M-blade 22 is illustrated in approximate form for drafting convenience. However, M-blades such as M-blade 22 are well known in the art and may have a variety of configurations.

Figure 2:
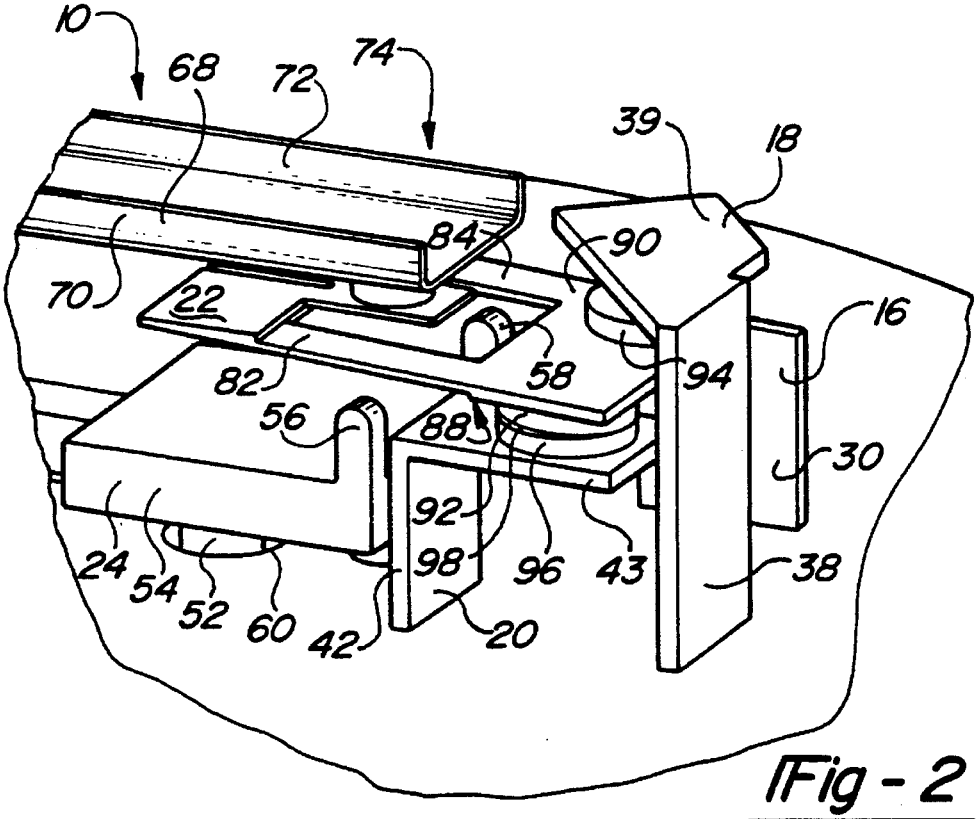
FIG. 2 is a perspective view of a portion of the switch of FIG. 1.
Figure 3:
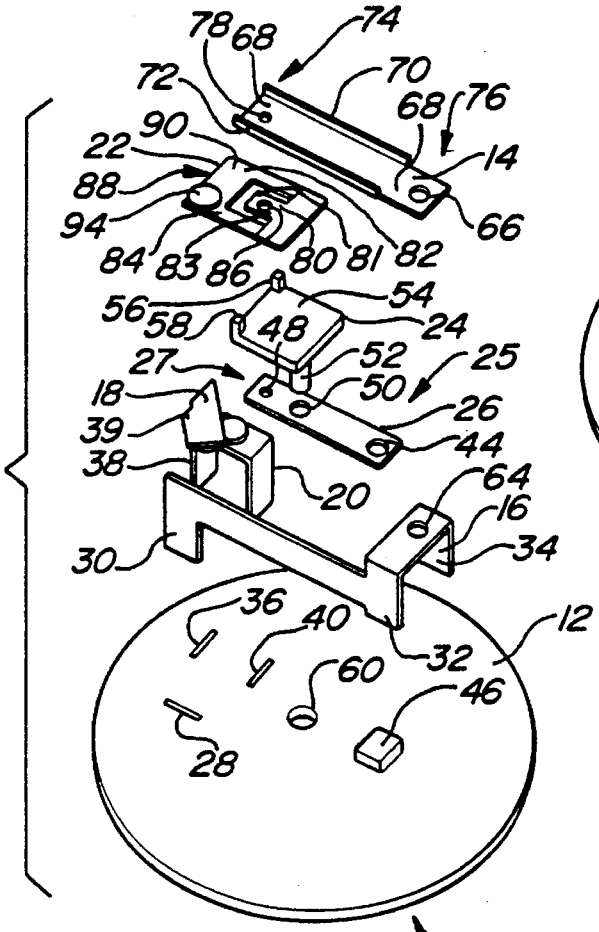
FIG. 3 is an exploded view of the switch of FIG. 1.
Figure 4:
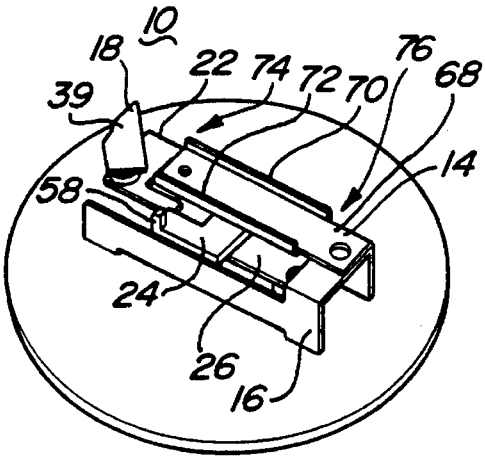
FIG. 4 is a second perspective view of the switch of FIG. 1.
Figure 6:
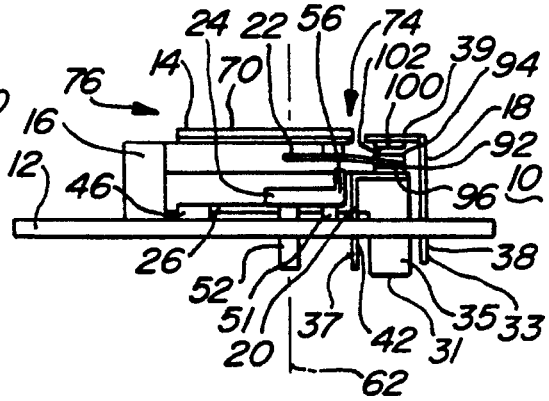
FIG. 6 is a side view of the switch of FIG. 1.
Figure 5:
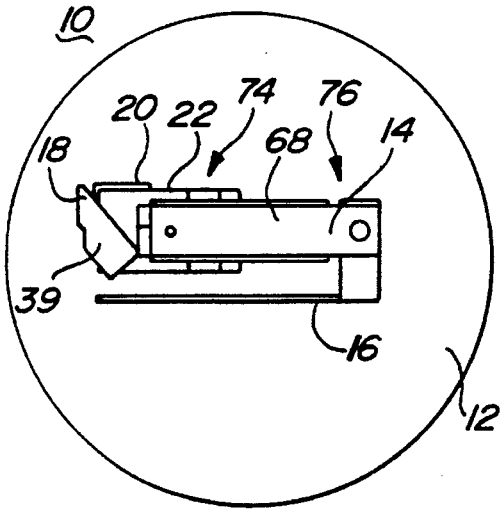
FIG. 5 is a top view of the switch of FIG. 1.

M-blade 22 may have any configuration suitable for operation as described herein. The center portion 80 includes an aperture 86. The center portion 80 of the M-blade 22 may be fastened to the first end 74 of the actuation arm 14 by means of a rivet screw or other fastener inserted through the aperture 78 and the aperture 86. The M-blade 22 is preferably a snap-acting mechanism of the type well known in the art. Insertion of a rivet, screw or other fastener in the aperture 86 forces apart the inner legs 81, 83 by an amount sufficient to stress the M-blade 22 so that it can and will snap between a first stable position or configuration and a second stable position or configuration. Alternatively, the M-blade 22 could be stressed by squeezing the first leg 82 and the second leg 84 together. The first stable position is illustrated in FIGS. 1 and 2, with the first and second legs 82, 84 of the M-blade 22 deflected proximate the horizontal portion 43 of the normally closed contact post 20. In the second stable position or configuration (not shown) the first and second legs 82, 84 of the M-blade deflect away from the normally closed contact post 20 and toward the horizontal portion 39 of the normally open contact post 18.

The M-blade 22 has a lower or first surface 88 and an upper or second surface 90. Preferably, a first contact 92 is affixed to the first surface 88. Further, preferably, a second contact 94 is affixed to the second surface 90. However, the first contact 92 and the second contact 94 may be omitted and electrical contact made to the metal M-blade 22 at a first contact surface or area (not shown) and a second contact surface or area (not shown), respectively. The horizontal portion 43 of the normally closed contact post 20 preferably includes a normally closed contact 96 having a normally closed contact surface 98. The normally closed contact 96 and the first contact 92 or first contact surface are located so as to mechanically engage in electrical contact when the M-blade 22 is in the first stable position or configuration, illustrated in FIGS. 1 and 2. Similarly, the horizontal portion 39 of the normally open contact post 18 preferably includes a normally open contact 100 having a normally open contact surface 102. The normally open contact 100 and the second contact 94 are located so as to mechanically engage in electrical contact when the M-blade 22 is in the second stable position or configuration.

The normally closed contact 96 and the normally open contact 100 may be omitted. In this alternate embodiment, the normally closed contact post 20 includes the normally closed contact surface 98 and the normally open contact post 18 includes the normally open contact surface 102. With the contact surfaces 98, 102 configured according to this alternate embodiment, the M-blade 22 mechanically engages the normally open contact post 18 and the normally closed contact post 20 for levering the M-blade 22 and completing an electrical connection between the normally open terminal 33 or the normally closed terminal 37 and the common terminal 31.

Also, while the normally closed contact 96 and the normally open contact 100 are illustrated in FIGS. 1–6 positioned on opposite sides of the M-blade 22, these contacts 96, 100 may be positioned on the same side or leg of the M-blade 22 and in line on the leg of the M-blade 22, or in any other configuration suitable for operation as described herein.

The first tab 56 and the second tab 58 of the reset button 24 are configured to engage the first leg 82 and the second leg 84 of the M-blade when force is applied to the reset post 52 along the axis 62. In addition to, or in place of the tabs 56, 58, the reset button 24 could include other structures configured to engage one or both legs 82, 84 of the M-blade 22, or the center portion 80 of the M-blade 22, or any other portion of the M-blade 22. However, as will be discussed below, the tabs 56, 58 preferably engage only the legs 82, 84.

Referring now to FIGS. *7a–7c*, they show a series of side representations of the switch 10 of FIGS. 1–6 illustrating operation of the switch 10 configured for detection of an overpressure condition. In this application, the switch 10 may, for example, complete an electrical connection between the normally closed terminal 37 and the common terminal 31 to provide electrical power or control to equipment such as a pump (not shown) which produces a fluid pressure. When an overpressure condition occurs, the switch 10 detects the overpressure condition and interrupts the electrical condition between the normally closed terminal 37 and the common terminal 31 completing an electrical connection between the normally open terminal 33 and the common terminal 31. This electrical connection may provide electrical power or control to equipment (not shown) which operates to correct the overpressure condition.

In FIG. *7a*, the M-blade 22 is in a first configuration. As illustrated in FIGS. *7a–7b*, a first plane 110 includes the first leg 82 and the second leg 84 of the M-blade 22. A second plane 112 includes the center portion 80 of the M-blade 22. In FIG. *7a*, in the first configuration, the first plane 110 is in a first intersecting relationship with the second plane 112. According to this configuration, the first contact 92 is in electrical contact with the normally closed contact 96. There is no electrical contact between the second contact 94 and the normally open contact 100. In FIG. *7a*, the M-blade 22 rests in the first stable position and the switch 10 awaits actuation, either from an input actuation to the actuation arm 14 represented by actuator 114 or a reset actuation applied to the M-blade 22, represented by reset actuator 116.

Figure 7A:
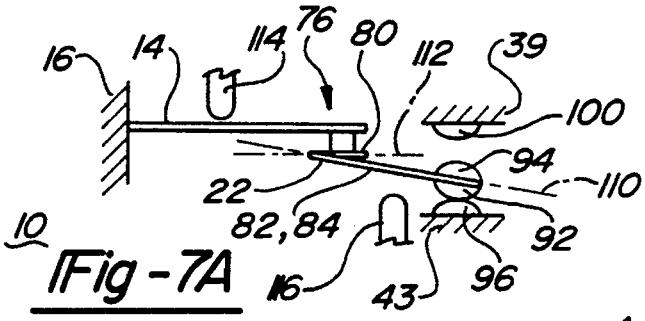
FIGS. 7*a*–7*c* are a series of side representations of the switch of FIG. 1 illustrating trip operation of the switch.
Figure 7B:
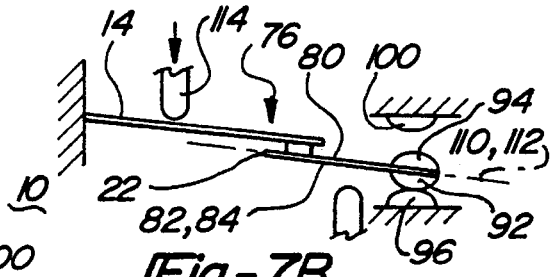
Figure 7C:
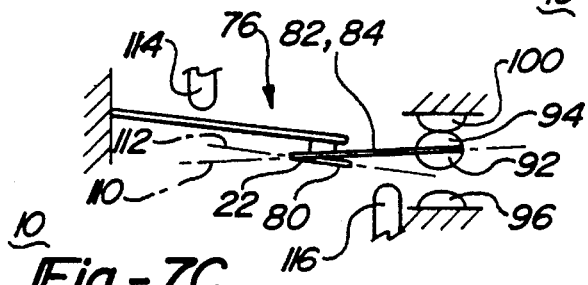

In FIG. 7*b*, an input actuation is applied to the actuation arm 14 by actuator 114. Actuator 114 may represent, for example, force applied to the actuation arm 14 by an increasing fluid pressure. The applied force and the relative displacement of the actuation arm 14, vary with the detected pressure. The force, applied in a first direction indicated by the arrow in FIG. 7*b*, moves the second end 76 of the actuation arm 14 in the first direction. Since the first contact 92 engages the normally closed contact 96, the M-blade 22 is constrained to lever from the first stable position (FIG. 7*a*) to the second stable position (FIG. 7*c*). That is, as the second end 76 of actuation arm 14 moves in the first direction in response to the input actuation, the angle between the first plane 110 and the second plane 112 become increasingly acute. In FIG. 7*b*, just before the M-blade 22 snaps, the first plane 110 and the second plane 112 are substantially coplanar. Thus, the M-blade 22 levers when the first plane 110 crosses the second plane 112.

A unique property of M-blades such as M-blade 22 is the increase in force applied by the M-blade 22 between the first contact 92 and the normally closed contact 96 as the M-blade approaches its snap point (FIG. 7*b*). This increased force reduces the susceptibility of the switch 10 to premature tripping caused by jarring or vibration of the switch 10. Moreover, this increased force reduces the likelihood of contact chatter or arcing, which may be associated with inaccurate operation of the switch 10 and reduced operating life of the switch 10 including the contacts 92, 94, 96, 100.

By varying the physical characteristics of the actuation arm 14, the force needed to move the second end 76 of the actuation arm 14 a sufficient distance to cause the M-blade 22 to snap may be varied. These physical characteristics include the thickness of the actuation arm 14, the length of the side portions 70, 72 (FIGS. 1–6) and the material forming the actuation arm 14. By varying the force necessary to move the second end 76, the set point or trip point (expressed in pounds per square inch, or PSI) of the switch 10 may be varied. Preferably, the actuation arm 14 is designed to be relatively weak; that is, to exert a relatively small restorative force when the actuation arm is deflected from its stable position. This restoration force should be less than the force required to lever the M-blade 22 from the second configuration (FIG. 7*c*) to the first configuration (FIG. 7*a*). If the restorative force was greater than this force, the switch 10 would be reset automatically.

As illustrated in FIG. 7*c*, the M-blade 22 is in the second configuration and the second contact 94 engages the normally open contact 100. In the second configuration, the first plane 110 is in a second intersecting relationship with the second plane 112. The input actuation, represented by actuator 114, has been reduced or eliminated as a result of the tripping of the switch 10 and interruption of the circuit which included the first contact 92 and the normally open contact 96. The switch 10, including M-blade 22, will remain in the second configuration illustrated in FIG. 7*c* until reset by the reset actuator 116.

Referring now to FIGS. 8*a*–8*e*, they show a series of side representations of the switch 10 of FIGS. 1–7 illustrating the reset operation of a switch 10 of FIGS. 1–7. Following detection and correction of an overpressure condition (FIG. 7*a*–7*c*), the switch 10 may be normally reset. Resetting the switch interrupts the electrical connection between the normally open terminal 33 and the common terminal 31 and completes the electrical connection between the normally closed terminal 37 and the common terminal 31.

Figure 8A:
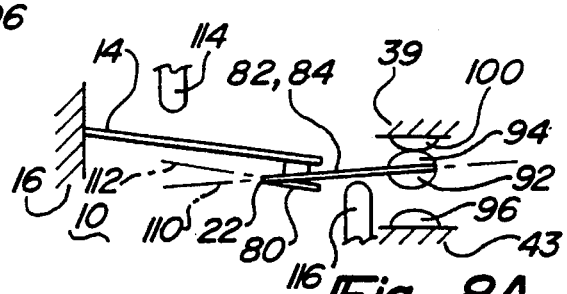
FIGS. 8*a*–8*e* are a series of side representations of the switch of FIG. 1 configured for detection of an overpressure condition, the figure illustrating reset operation of the switch of FIG. 1.
Figure 8B:
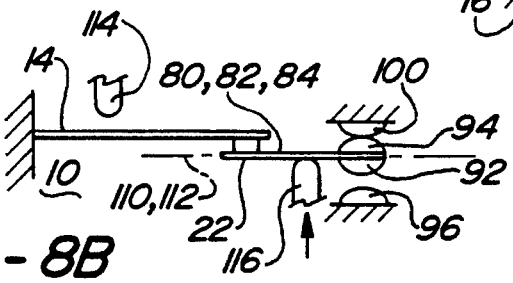
Figure 8C:
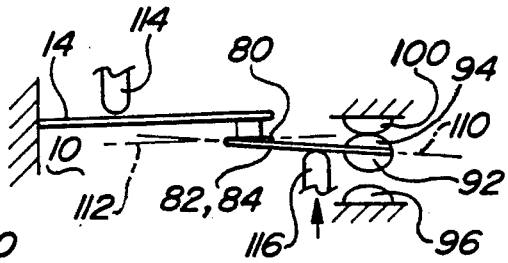
Figure 8D:
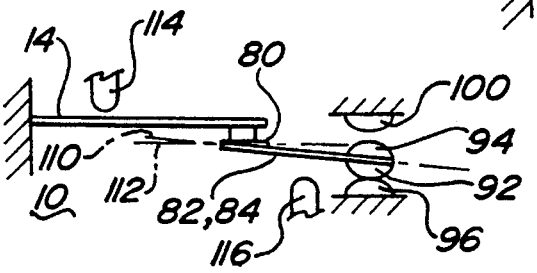

In FIG. 8*a*, the M-blade 22 is in the second configuration and the second contact 94 engages the normally open contact 100. In FIG. 8*b*, a reset actuation is applied to the M-blade 22 by the reset actuator 116. The reset actuator 116 may be, for example, the reset button 24 or the tabs 56, 58 of the reset button 24, illustrated in FIGS. 1–6. Preferably, the reset actuation is applied in a second direction, indicated by the arrow in FIGS. 8b, 8c and Be, to the legs 82, 84 of the M-blade 22. As illustrated in FIG. 8b, the reset actuation applied to the M-blade 22 moves the actuation arm 14 in the second direction. Since the second contact 94 engages the normally open contact 100, the M-blade 22 is constrained to lever from the second configuration (FIG. 8*a*) to the first configuration (FIG. 8*b*). That is, as the actuation arm 14 moves in the second direction, the first plane 110 including the legs 82, 84 of the M-blade 22 crosses the second plane 112 including the center portion 80 of the M-blade 22. When the first plane 110 crosses the second plane 112 (FIG. 8*b*), the M-blade 22 snaps from the second configuration to the first configuration. With the switch 10 reset and the M-blade 22 in the first configuration (FIG. 8*d*), the reset actuator 116 can be withdrawn from engagement with the M-blade 22. When the reset actuator 116 is withdrawn (FIG. 8*d*), the first contact 92 engages the normally closed contact 96 (FIG. 8*d*). The switch 10 awaits a further input actuation applied by the actuator 114.

Preferably, the reset actuator 116 engages one or both of the legs 82, 84 of the M-blade 22. By engaging the legs 82, 84, the force is applied indirectly to the M-blade by the reset actuator 116. The effect on the setpoint of the switch 10 (the pressure applied to the actuation arm 14 sufficient to move the actuation arm 14 so that the M-blade 22 snaps) is negligible. In contrast, if the reset actuator 116 applies reset force to the center portion 80 of the M-blade 22, the setpoint of the switch 10 may be changed and the trip point may not be reached. That is, the reset force may be insufficient to overcome the input actuation if the reset force is applied to the center 80 of the M-blade 22.

Figure 8E:
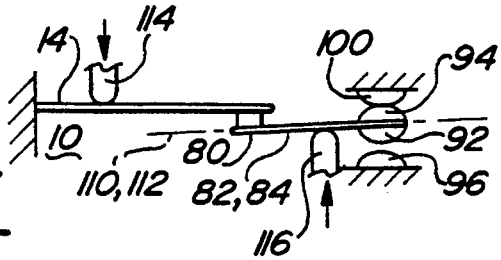

FIG. 8*e* illustrates trip free operation of the switch 10. In FIG. 8*e*, an input actuation, represented by the arrow at the left of FIG. 8*e*, is applied in a first direction by the actuator 114 to the actuation arm 14. At the same time, a reset actuation, represented by the arrow at the right of FIG. 8*e*, is applied in a second direction to the M-blade 22. As illustrated in FIG. 8*e*, the effect of the input actuation is to cause the M-blade to lever from the first configuration (first contact 92 engaging normally closed contact 96) to the second configuration (second contact 94 engaging normally open contact 100). Similarly, the effect of the reset actuation applied by the reset actuator 116 is to push the first contact 92 away from the normally closed contact and to push the second contact 94 into engagement with the normally open contact 100. The actuation arm 14 therefore moves between a first position (FIG. 8*d*) and a second position (FIG. 8*a*). The reset actuator 116 can only cause the M-blade 22 to lever from the second configuration (FIG. 8*a*) to the first configuration (FIG. 8*d*) when the actuation arm is in the second position. Thus, the operation of the switch 10 to interrupt a circuit including normally closed contact 96 and first contact 92 cannot be defeated by prematurely operating the reset actuator 116, such as reset button 24 (FIGS. 1–6). Moreover, since the reset force is applied to the legs 83, 84 of the M-blade 22 rather than the center 80, the input actuation is not impeded by force due to the reset actuation. The switch 10 provides trip free reset operation.

Preferably the displacement of the reset actuator 116, such as the reset button 24 (FIGS. 1–6) is limited to the amount necessary to cause the M-blade 22 to lever from the second configuration (FIG. 8*a*) to the first configuration (FIG. 8*b*). For example, some means (not shown) of limiting the force transmitted in the second direction to the M-blade 22 by the reset button 24 may be provided. Alternatively, a mechanical stop (not shown) may be provided.

Referring now to FIGS. 9*a*–9*g*, they show a series of side representations of a switch 210 configured for detection of an underpressure condition. FIGS. 9*a*–9*g* illustrate trip and reset operation of the switch 210. This operation of the switch 210 is similar to operation of the switch 10 illustrated in FIGS. 1–6.

In FIGS. 9*a*–9*g*, the switch 210 includes an actuation arm 214, a common contact post 216 and an M-blade. The M-blade 222 is similar to the M-blade discussed above in connection with FIGS. 1–6 and includes a center portion 280 and a first leg 282 and second leg 284. The actuation arm 214 is connected to the common contact post 216 at a first end 274. The M-blade 222 is connected to the second end 276 of the actuation arm. The M-blade 222 includes a first contact 292 and a second contact 294.

Figure 9A:
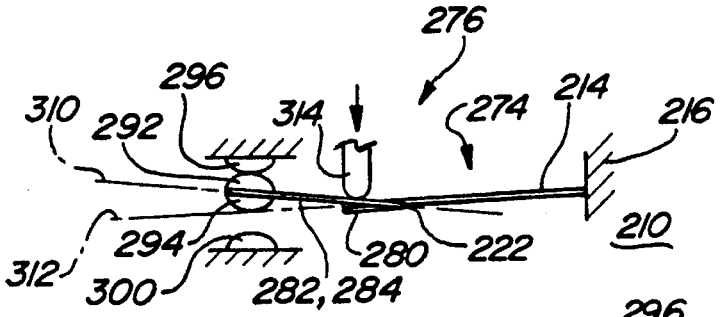
FIGS. 9*a*–9*g* are a series of side representations of a switch configured for detection of an underpressure condition, the figures illustrating trip and reset operation of the switch of FIG. 1.

As illustrated in FIG. 9*a*, the M-blade 222 is in a first configuration. In the first configuration, the first contact 292 is in electrical contact with the normally closed contact 296. There is no electrical contact between the second contact 294 and the normally open contact 300. A first plane 310 includes the first leg 282 and the second leg 284 of the M-blade 222. A second plane 312 includes the center portion 280 of the M-blade 222. The M-blade 222 rests in the first stable position and the switch 210 awaits actuation.

In FIG. 9*a*, a force (indicated by the arrow) is applied to the actuation arm 214 by an input actuator 314. The force may be representative of or produced by a fluid pressure. The applied force, and the relative displacement of the actuation arm 214, vary with the detected pressure. The actuation arm 214 is preferably flexible so that the second end 276 of the actuation arm 214 flexes or moves in a first direction (downward in FIG. 9*a*) in response to the applied force, but the flexing of the actuation arm 214 urges the actuation arm 214 in a second direction opposite the first direction (upward in FIG. 9*a*). This applied force thus forms an input actuation to the switch 210.

In this manner, the switch 210 is configured for detection of an underpressure condition. An underpressure condition exists when the detected pressure, and therefore the force exerted on the actuation arm 214, falls below a predetermined threshold. When the underpressure condition occurs, the switch 210 trips to break the electrical connection formed between the first contact 292 and the normally closed contact 296 and to complete an electrical connection between the second contact 294 and the normally open contact 300.

Figure 9B:
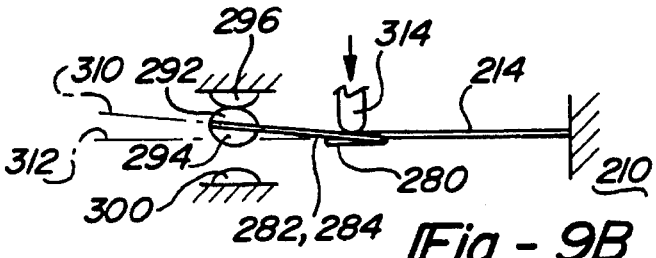

In FIG. 9*b*, the detected pressure has decreased relative to the detected pressure in FIG. 9*a*, allowing second end 276 of the actuation arm 214 to move upward. The first plane 310 has approached, but not yet crossed the second plane 312. As described above, the M-blade 222 will snap when the first plane 310 crosses the second plane 312.

Figure 9C:
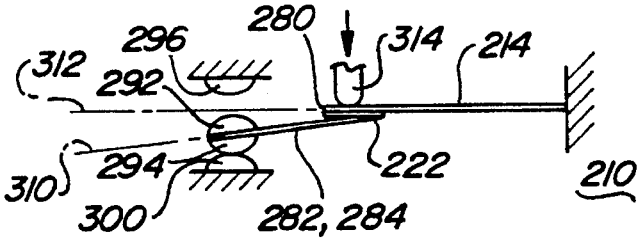
Figure 9D:
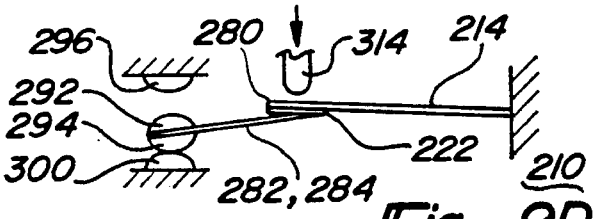

In FIG. 9*c*, the detected pressure has decreased still further and is at the predetermined, low-pressure threshold. The first plane 310 has crossed the second plane 312 and the M-blade 222 has snapped so that the M-blade 222 is in the second configuration. In the second configuration, the second contact 294 engages the normally open contact 300 and the first contact 292 is no longer in electrical contact with the normally closed contact 296. In FIG. 9d, the detected pressure is below the predetermined low-pressure threshold and the input actuator 314 is no longer in contact with the actuation arm 214. The M-blade 222 remains in the second configuration.

Figure 9E:
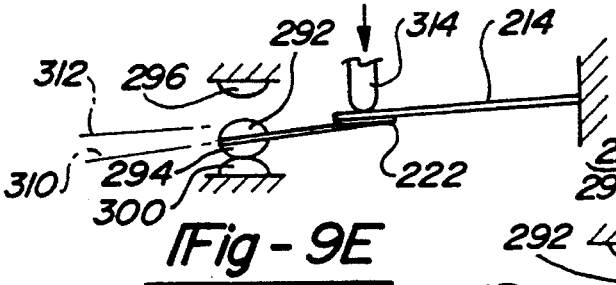

In FIG. 9*e*, the detected pressure has increased and again exceeds the predetermined low-pressure threshold. However, because the switch 210 has not been reset, the M-blade 222 remains in the second configuration, with the second contact 294 in electrical contact with the normally open contact 300. To maintain this configuration in the presence of detected pressure, the vertical positioning (as illustrated in FIG. 9*e*) of the normally open contact 300 may be adjusted so that the vertical displacement of the actuation arm 214 in response to the detected pressure cannot cause the second plane 312 to cross the first plane 310 thereby snapping the M-blade 222 back to the first configuration and resetting the switch 210.

Figure 9F:
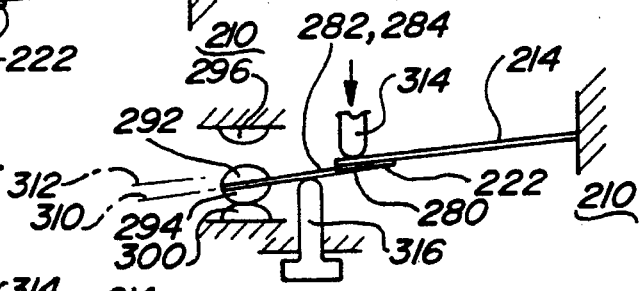
Figure 9G:
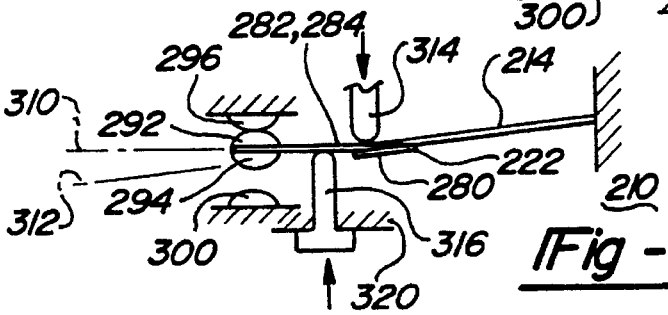

FIGS. 9*f* and 9*g* illustrate reset operation of the switch 210. In FIG. 9*f*, the M-blade 222 is in the second configuration with the second contact 294 in electrical contact with the normally open contact 300 and with no electrical contact between the first contact 292 and the normally closed contact 296. The detected pressure, represented by the arrow in FIG. 9*f*, is above the predetermined low-pressure threshold, but the switch 210 has not been reset. A reset actuator 316 is illustrated in FIGS. 9*f* and 9*g* to provide a reset actuation to the switch 210.

In FIG. 9*g*, the detected pressure exceeds the predetermined low-pressure threshold and the reset actuator 316 applies a reset actuation to reset the switch 210. The reset actuator 316 engages the legs 282, 284 of the M-blade 222. The force exerted upon the legs 282, 284 in a first direction (upward in FIG. 9*g*) and the force exerted on the center portion 280 of the M-blade 222 by the input actuator 314 in a first direction (downward in FIG. 9*g*) cause the first plane 310 to cross the second plane 312 and the M-blade 222 to lever from the second configuration (FIG. 9*f*) to the first configuration (FIG. 9*g*). Thus, the switch 210 is reset.

Preferably, a stop 320 or other means is provided for limiting the extent of travel of the reset actuator 316. The extent of travel of the reset actuator must be limited to ensure the switch 210 is trip-free. If the extent of travel of the reset actuator were not so limited, the reset actuation could be sufficient to prevent levering of the M-blade 222 in the event of a detected underpressure condition, thereby defeating the protective operation of the switch.

In an alternative embodiment, the reset function could be provided to the switch 210 by applying the reset actuation directly to the normally open contact 300, moving the normally open contact in the second direction (upward in FIG. 9*g*). This variation ensures that, even if the reset actuator 316 is continuously depressed, the electrical contact between the second contact 294 and the normally open contact 300 is maintained.

Figure 10:
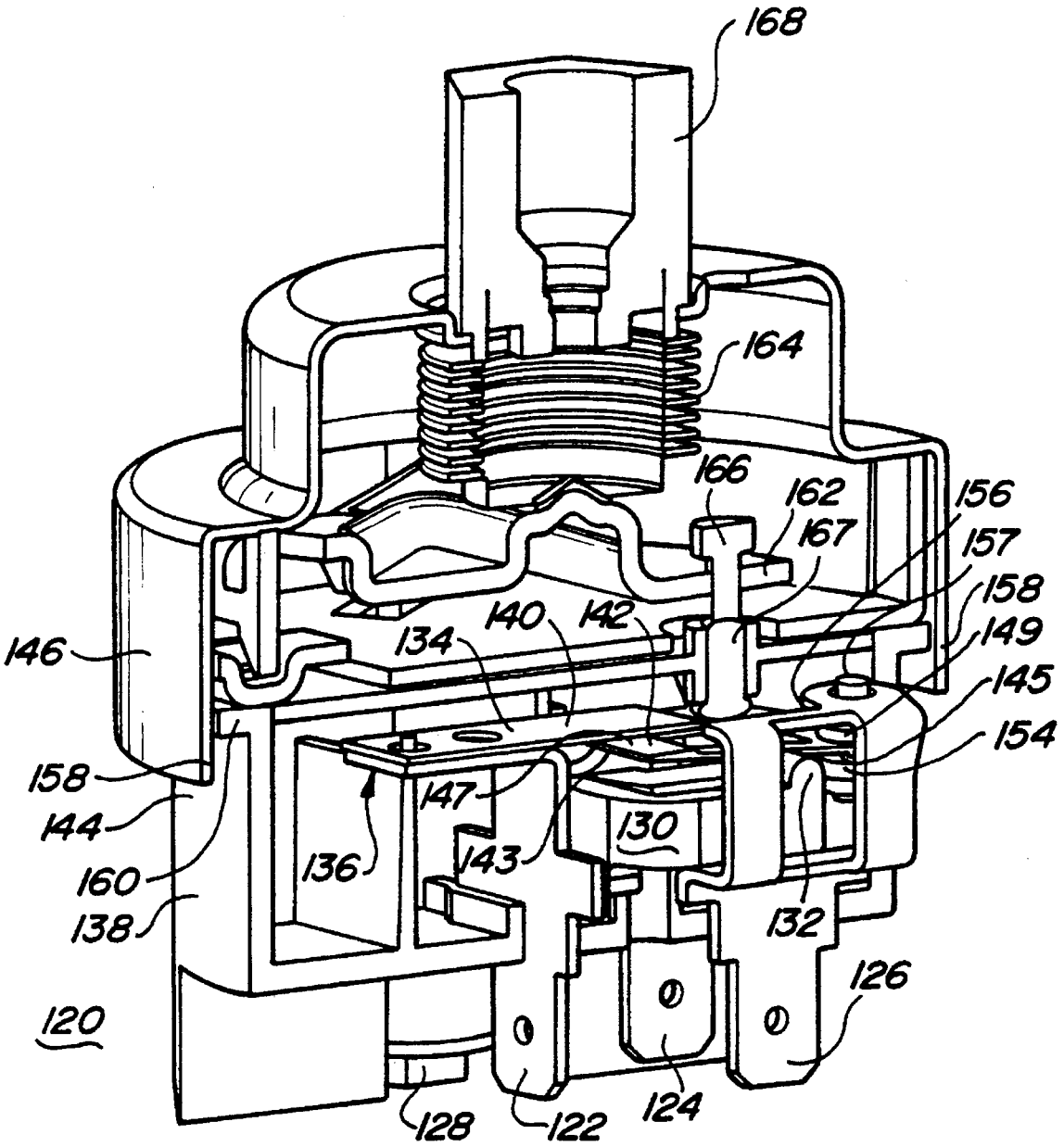
FIG. 10 is a cutaway view of a second embodiment of a switch.
Figure 11:
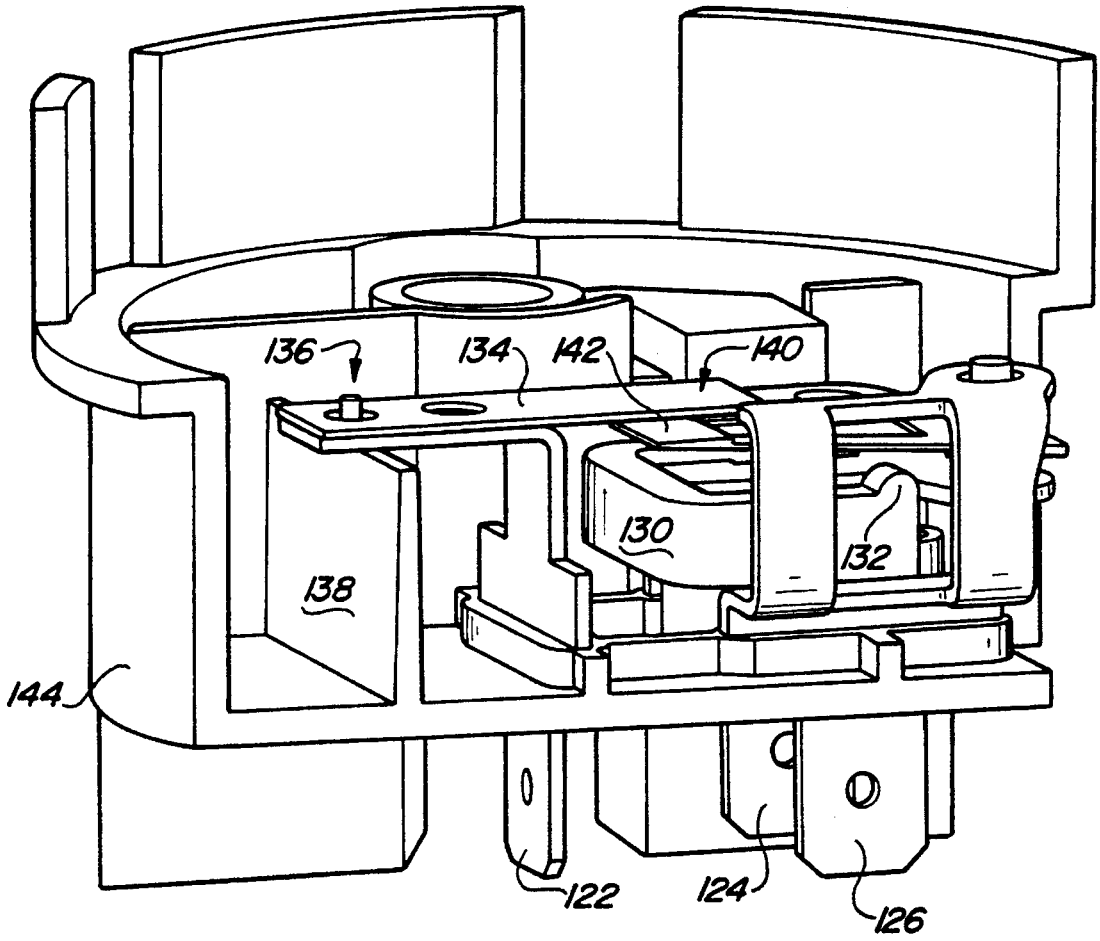
FIG. 11 is a cutaway view of the switch of FIG. 9 with a portion of the structure of the switch removed to show interior details of the switch.

FIG. 10 is a cutaway view of a second embodiment of a switch 120. FIG. 11 is a cutaway view of the switch 120 of FIG. 10 with a portion of the structure of the switch 120 removed to show interior details of the switch 120. The switch 120 has a common terminal 122, a normally closed terminal 124 and a normally open terminal 126 for making electrical contact to other portions of a circuit (not shown) with which the switch 120 is used. The switch 120 further includes a reset button 128 having a body 130 and a first tab 132. The reset button 128 preferably has a second tab (not shown in FIGS. 10 and 11). The common terminal 122 is in electrical contact with an actuation arm 134. The first end 136 of the actuation arm 134 is rigidly fixed to the body 138 of the switch 120.

Attached to the second end 140 of the actuation arm 134 is an M-blade 142. The M-blade 142 includes a first outer arm 141 and a second outer arm (not shown). Attached to a first surface 143 of the M-blade 142 is a first contact 145. Attached to a second surface 147 of the M-blade 142 is a second conttact 149. The M-blade 142 is preferably configured In a first configuration, the M-blade 142 engages and is in electrical contact with a normally closed contact 154 which, in turn, is in electrical contact with the normally closed terminal 124. In a second configuration, the M-blade 142 engages and is in electrical contact with a normally open contact 156 which, in turn, is in electrical contact with the normally open terminal 126. A stem portion 157 of the normally open contact 156 is visible in FIG. 10. Force applied to the actuation arm 134 levers the M-blade from the first configuration to the second configuration. Force applied to the reset button 128 levers the M-blade from the second configuration to the first configuration.

The body 138 of the switch 120 includes a non-conducting first portion 144 and a second portion 146. Preferably, the first portion 144 and the second portion 146 are fastened together by crimping the lip 158 of the second portion 146 over the step 160 in the first portion 144. The second portion 146 of the body 138 includes a lever 162 and a bellows 164. The lever 162 is coupled to the actuation arm 134 by an adjustment screw 166 and an operating pin 166. Further, the second portion 146 includes a fitting 168 by which the switch 120 may be coupled to a means for detecting fluid pressure within the system. For example, the switch 120 may detect refrigerant pressure in a refrigeration compressor. The switch may be used to control refrigerant pressure in a refrigeration system and to protect and prevent overpressure conditions. In response to the pressure in the system received at the fitting 168, the bellows 164 expands or contraction. Expansion or contraction of the bellows 164 moves the lever 162. The lever 162 is mechanically connected to the second end 140 of the actuation arm 134 by adjusting screw 167 and operating pin 166. Motion of the lever 162 is conveyed to the actuation arm 134 through the adjusting screw 167 and operating pin 166 and represents an input actuation to the switch 120. In response to this motion or input actuation, the M-blade 142 levers between the first configuration and the second configuration.

As can be seen from the foregoing, the present invention provides a switch for detecting a mechanical overpressure or underpressure condition. Tripping the switch breaks or interrupts a first electrical circuit including a normally closed contact and completes a second electrical circuit including a normally open contact. An M-blade is used as a snap-acting mechanism to provide precise control of the set point or trip point of the switch because the force applied by the M-blade to the normally closed contact actually increases as the M-blade approaches the snap point. The switch is particularly useful in applications featuring high vibration or jarring. In addition, the switch provides trip free manual reset operation. Force applied to a reset button is transferred to the M-blade, causing the M-blade to lever or snap. Because the force applied by the reset button pushes the M-blade away from the normally closed contact, and because the reset actuation cannot limit or prevent the input actuation, the reset operation is truly trip free.

While particular embodiments of the present invention have been shown and described, modifications may be made, and it is therefore intended in the appended claims to cover all such changes and modifications which fall within the true spirit and scope of the invention.

I claim:

1. A fluid pressure detection switch for interrupting an electrical circuit in response to a detected pressure condition, the pressure detection switch having a base and a first terminal, a second terminal and a common terminal, the terminals in electrical communication with the electrical circuit, the pressure switch comprising:

an actuation arm cantilevered to the base and electrically coupled to the common terminal, the actuation arm being movable between a first position and a second position in response to a pressure condition;

an M-blade operatively coupled to and electrically communicating with the actuation arm, the M-blade levering from a first configuration to a second configuration when the actuation arm moves from the first position to the second position, the M-blade electrically communicating with the first terminal in the first configuration and electrically communicating with the second terminal in the second configuration; and a reset actuator coupled to the base and engaging the M-blade in response to a reset actuation, the M-blade levering from the second configuration to the first configuration when the reset actuator engages the M-blade and the actuation arm is not in the second position.

2. A pressure detection switch as defined in claim 1 wherein the M-blade comprises a center portion fixed to one end of the actuation arm and a first leg and a second leg joined to the center portion, the first leg and the second leg lying in a first plane, the center portion lying in a second plane, the M-blade levering between the first configuration and the second configuration when the first plane crosses the second plane.

3. A pressure detection switch as defined in claim 2 wherein the first terminal comprises a normally closed contact and the second terminal comprises a normally open contact.

4. A pressure detection switch as defined in claim 3 wherein the reset actuator comprises one or more tabs engaging at least one of the first leg and the second leg in response to the reset actuation.

5. A pressure detection switch as defined in claim 4 wherein the one or more tabs urge the M-blade against the normally open contact and urge the actuation arm toward the first position in response to the reset actuation.

6. A pressure detection switch as defined in claim 5 further comprising a bellows operatively coupled to the actuation arm, the bellows displacing the actuation arm in response to the detected pressure.

7. A fluid actuated switch for selectively electrically coupling a common contact with a normally closed contact or a normally open contact, the switch comprising:

a base, an actuation arm cantilevered to the base at a first end and in electrical contact with the common contact and having a second end, the second end moving in a first direction in response to an input actuation;

an M-blade in electrical contact with the actuation arm, the M-blade having a center portion fixed to the second end of the actuation arm and a first contact and a second contact, the M-blade levering to move the first contact from electrical contact with the normally closed contact and to move the second contact into electrical contact with the normally open contact when the second end of the actuation arm moves in the first direction; and a reset actuator coupled to the base having one or more tabs which move in a second direction opposite the first direction engaging the M-blade in response to a reset actuation, the M-blade levering to move the first contact into electrical contact with the normally closed contact and to move the second contact from electrical contact with the normally open contact.

8. A switch as defined in claim 7 wherein the M-blade further includes a first leg and a second leg and a first surface and a second surface, the first leg including the first contact on the first surface and the second leg including the second contact on the second surface, the M-blade levering when a first plane including the first leg and the second leg crosses a second plane including the M-blade center portion.

9. A switch as defined in claim 8 wherein the normally closed contact includes a normally closed contact surface generally parallel to the M-blade first surface, the first contact engaging the normally closed contact surface when the switch electrically couples the common contact with the normally closed contact.

10. A switch as defined in claim 9 wherein the normally open contact includes a normally open contact surface generally parallel to the M-blade second surface, the second contact engaging the normally open contact surface when the switch electrically couples the common contact with the normally open contact.

11. A switch as defined in claim 10 wherein the first leg and the second leg have a first stable position proximate the normally closed contact and a second stable position proximate the normally open contact, the M-blade levering between the first stable position and the second stable position.

12. A switch as defined in claim 8 wherein the reset actuator has a first tab which engages the first leg and a second tab which engages the second leg to move the actuation arm in a second direction opposite the first direction to lever the M-blade about the normally open contact until the first plane crosses the second plane.

13. A switch as defined in claim 12 wherein the second end of the actuation arm is attached to a base, the actuation arm flexing to move in the first and second directions.

14. A switch as defined in claim 12 wherein the actuation arm responds to an overpressure condition.

15. A switch as defined in claim 8 wherein the reset actuator has a first tab which engages the first leg and a second tab which engages the second leg to move the actuation arm in a second direction opposite the first direction to move the first plane across the second plane when the actuation arm is constrained from moving in a second direction by an input actuation.

16. A switch as defined in claim 15 wherein the actuation arm responds to an underpressure condition.

* * * * *